United States Patent [19]

Salice

[11] 4,332,053

[45] Jun. 1, 1982

[54] CONCEALED HINGE FOR DOORS, FLAPS, OR THE LIKE

[75] Inventor: Luciano Salice, Carimate, Italy

[73] Assignee: Deutsche Salice GmbH, Freiberg, Fed. Rep. of Germany

[21] Appl. No.: 126,299

[22] Filed: Mar. 3, 1980

[30] Foreign Application Priority Data

Mar. 30, 1979 [DE] Fed. Rep. of Germany ..... 2912627

[51] Int. Cl.[3] ..... E05D 3/06

[52] U.S. Cl. ..... 16/370

[58] Field of Search ..... 16/163, 164

[56] References Cited

U.S. PATENT DOCUMENTS

| | | | |
|---|---|---|---|
| 3,590,420 | 7/1971 | Salice | 16/164 |
| 3,724,021 | 4/1973 | LautenscHläeger | 16/164 X |
| 3,744,086 | 7/1973 | Salice | 16/164 |
| 3,864,786 | 2/1975 | Salice | 16/163 |
| 3,940,829 | 3/1976 | Grunert et al. | 16/163 |
| 4,152,811 | 5/1979 | LautenscHläeger | 16/163 |

FOREIGN PATENT DOCUMENTS

| | | |
|---|---|---|
| 2117828 | 5/1972 | Fed. Rep. of Germany . |
| 1801310 | 8/1978 | Fed. Rep. of Germany . |

*Primary Examiner*—Louis Rimrodt

*Attorney, Agent, or Firm*—Hedman, Casella, Gibson & Costigan

[57] ABSTRACT

A concealed furniture hinge which comprises a stationary hinge portion and a cup-shaped pivotable hinge portion, both pivotally interconnected by two links to form a four-bar linkage. The stationary hinge portion comprises a securing plate and two parallel upstanding bearing flanges. Pivot pins for the respective links are secured in the bearing flanges at a height so that, when the hinge is closed, they project into the cup-shaped hinge portion to at least beneath the top of a securing flange thereof. Said securing flange comprises at least one flat member which, in the closed hinge condition, is disposed adjacent the securing plate of the stationary hinge portion.

51 Claims, 6 Drawing Figures

CONCEALED HINGE FOR DOORS, FLAPS, OR THE LIKE

The invention relates to a concealed hinge for doors, flaps or the like comprising a stationary hinge portion and a pivotable cup-shaped hinge portion which is provided with a securing flange, said hinge portions being pivotally interconnected by two links to form a four-bar linkage.

Hinges of this kind known, for example, from DE-AS 18 01 310 and DE-OS 21 17 828 comprise elongate strip-like supporting wall abutment members which form the stationary hinged portion. Such supporting wall abutment members are usually secured by screws to the inside of fixed furniture walls so that they extend perpendicular to the door or flap when the latter is in the closed condition. The pivotable cup-shaped hinge portion is secured in the door or flap. The front end of the supporting wall abutment member that projects beyond the supporting wall enters the cavity of the cup-shaped hinge portion.

These known hinges merely permit those doors or flaps to be pivoted to furniture walls that extend at right-angles thereto in the closed condition. However, there is a requirement to pivot doors, flaps or the like to wall or frame members which, in the closed condition of the doors or flaps, are disposed in a plane parallel thereto. For example, there are construction systems in which the side, base and top walls of an item of furniture are covered or strengthened by an end frame of battens so that the doors or flaps must be hinged to this frame which is disposed in a plane parallel thereto in the closed condition.

Numerous hinges are known, particularly in the U.S.A., in which the stationary hinge portion is secured to the front of the end frame and remains visible together with the rolled-in eyes of both hinge portions in which the pivot pins are accommodated.

Hinges of the aforementioned kind are also known which can be secured to the end frame composed of battens. However, these hinges always comprise a strip-like elongate stationary hinge portion of the kind known from DE-AS 18 01 310 or DE-OS 21 17 828, which is secured in a semi-cylindrical fitting provided with securing flanges. To fix this semi-cylindrical fitting to the end frame, the latter must be provided with complementary semi-circular recesses which must be so cut into the inner edges of the end frame that the interrupted edges form the limiting planes of semi-cylindrical recesses. This known concealed hinge not only has the disadvantage that its securing points are fixed by the semi-cylindrical recess in the edge of the end frame and the cylindrical bore for receiving the cup-shaped hinge portion in the door or flap, so that the element which is hinged to the end frame can no longer be aligned or displaced in the longitudinal direction, but also the disadvantage that for assembling this hinge one requires two special tools, namely one for drilling the cylindrical bore for the pivotable hinge portion and another for cutting the semi-cylindrical recess into the end frame to secure the stationary hinge portion. Another disadvantage results from the fact that the pivotable hinge portions of hinges of the aforementioned kind swing outwardly during closing only by a distance determined by the length of the links, so that the amount by which the pivotable hinge portion overlaps the stationary hinge portion in the closed position is fixed. Furthermore it is not possible to increase this amount at will because this would also necessitate an uneconomic increase in the diameter of the pivotable cup-shaped hinge portion. Thus, if the outer edge of a flap or door hinged by means of the known hinge is to be flush with the outer edge of the end frame, the latter can only be formed of battens of narrow width despite the fact that the stationary hinge portion is sunk into semi-cylindrical recesses.

In modern furniture it is conventional to allow for the possibility of several different combinations within one particular furniture design so that an end frame of standard size can be closed by a single door or by several doors of different heights, it also being possible to include open shelves or drawers between the individual doors. Since for the purpose of mounting the known hinge the end frame must be provided with semi-cylindrical recesses, such a possibility of different combinations is severely restricted or, at best, made difficult because the recesses can usually be applied to the end frames only during assembly when it is known for which particular embodiment of the item of furniture the end frame is intended. Apart from the fact that the semi-cylindrical recesses in the end frames detrimentally effect the aesthetic appearance of the furniture, economical pre-assembly is therefore not possible when using the known hinge.

It is therefore the object of the present invention to provide a concealed hinge of the aforementioned kind, in which the stationary hinge portion can be secured in a simple manner at any desired position on the surface of a wall or frame member to which the hinged door or flap is parallel in the closed condition.

According to the invention, this object is achieved in that the stationary hinge portion consists of a flat securing plate which two parallel bearing flanges perpendicular thereto, such that the pivot pins for the two links are secured at such a height in the bearing flanges that, in the closed position of the hinge, they project into the cup-shaped hinge portion to at least under the top of the securing flange, and that the securing flange consists of at least one flat plate-like member which, in the closed position, lies adjacent the securing plate in the plane thereof. In the hinge according to the invention, the hinge pins mounting the links on the stationary hinge portion are secured in bearing flanges which upstand from a planar securing plate. In the closed position, the securing pins of the bearing flanges project so far into the recess of the pivotable cup-shaped hinge portion that they no longer project beyond the securing flange of the pivotable hinge portion that is disposed in the same plane as the securing plate of the fixed hinge portion in the closed position. The securing plate of the stationary hinge portion can, in known manner such as by countersunk screws, be secured to any desired position of a planar surface, for example the front of an end frame. In the closed position, there is a gap between the door or flap pivoted by the hinge of the invention and the surface on which the securing plate of the stationary hinge portion is screw-connected, the gap corresponding to the thickness of the securing plate and the securing flange. However, this gap is an acceptable sacrifice because the securing plate as well as the securing flange can be kept thin. The stationary hinge, portion of the hinge according to the invention, can be fixed in a simple manner by conventional screw connections so that, for example, within the scope of a single furniture design, variations can be carried out in a simple manner without the need for undertaking special operations such as adapting an end frame. The hinge according to the invention can for example be fixed to end frames of furniture in the same simple way as the supporting wall abutment portions of hinges such as those known from DE-OS 21 17 828 are secured to the side walls of furniture.

Desirably, the securing flange is disposed on the outside of the cup-shaped hinge the securing flange portion and, on closing the hinge, swings to pass over and beyond the securing plate into the plane thereof without overlap. The term 'outside' is to be understood to mean the side facing the adjoining edge of the door or flap. This construction permits the securing plate and the securing flange to be arranged in a simple manner and without obstruction so that in the closed position they are closely juxtaposed in one plane without obstructing or overlapping each other.

In a further form of the invention, it is provided that the parts of the bearing flanges carrying the outer pivot pin project beyond the outer edge of the securing plate. This ensures that the outer pivot pins of the bearing flanges can pass without obstruction through the securing plate to project into the cavity of the pivotable cup-shaped hinge portion.

Desirably, the lower edges of the bearing flanges are flush with the underside of the securing plate.

The securing plate may have a recess between the bearing flanges so that the end of the outer link can also be rolled about the outer pivot pin without being obstructed by the securing plate.

For stiffening purposes, the bearing flanges can be interconnected on their inside by a perpendicular web.

Desirably, the securing plate comprises an outer edge which is parallel to the bearing pins and, in the closed position of the hinge, abuts in front of the parallel inner edge of the securing flange. This brings about a compact construction.

The securing plate may have a flanged limb for securing to a perpendicular side of the fixed wall or frame member. This may simplify assembly of the stationary hinge portion.

The securing plate preferably comprises an angle member which is referred to as the flanged limb, and which is provided with an elongate hole or slot for a fixing screw securable in a fitting which has a retaining portion parallel to the limb. The fitting can be preassembled in a simple manner so that the securing plate can be simply fixed thereon by turning only one screw. Further, the securing plate can be tightened on the fitting at a different height to simplify the setting of the gap for example between the door or flap and an end frame.

The fitting may comprise two angle members interconnected by a web which forms the retaining member and is parallel to the flanged limb of the securing plate. Desirably, the limb of the fitting parallel to the securing plate has a recess which corresponds to the width of the securing plate and in which the securing plate is framed in a bifurcated manner.

In a manner known per se, the hinge according to the invention can be provided with a spring which, near the closed position, biasses the hinge to the closed position and which is supported on the one hand by one hinge portion and on the other hand directly or indirectly by a projection connected to one link.

An example of the invention will now be described in more detail with reference to the drawing, wherein.

Figure 3:
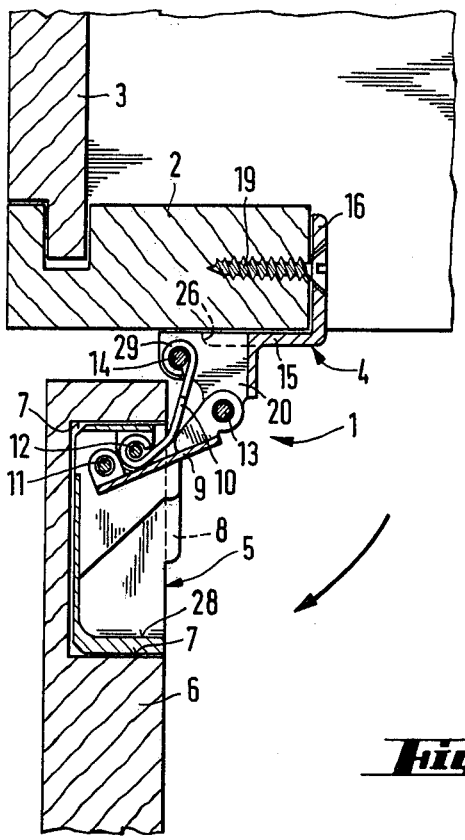
FIG. 3 is a view similar to FIG. 1 of a further embodiment of a hinge in the open condition.

The hinge 1 shown in FIG. 3 is secured by its stationary hinge portion 4 to a vertical batten 2 of an end frame, the batten 2 being connected to a vertical wall 3 of an item of furniture. The parts 2, 3 can be regarded as a horizontal section through the corner of an item of furniture. The pivotable cup-shaped hinge portion 5 of cylindrical outer shape is set into a complementary cylindrical bore 7 of the door 6 and is secured in this bore by securing flanges 8 into which screws (not shown) are screwed. The securing flanges 8 are made in one piece with the cup-shaped hinge portion 5.

The links 9, 10 connecting the fixed hinge portion 4 to the pivotable hinge portion 5 are mounted on the one hand on pivot pins 11, 12 secured in the pivotable hinge portion 5 and on the other hand on pivot pins 13, 14 secured on the fixed hinge portion 4, mounting being in a manner such that the hinge portions 4, 5 form a four-bar linkage together with the links 9, 10. The pivot pins 11, 12 are held in the wall of the cup-shaped hinge portion 5 in a manner to be subsequently described in more detail with reference to FIG. 4.

The fixed hinge portion 4 consists of a planar securing plate 15 held at the front of the batten 2 of the end frame of an item of furniture. A limb 16 flanged at right-angles from the securing plate 15 is provided with a bore 17 and an elongate hole 18 for fixing screws 19. In the outer marginal portion of the securing plate 15, spaced parallel bearing flanges 20, 21 are connected thereto at right-angles and upstand therefrom perpendicularly. The bearing flanges are provided with bores 22, 23 and 24, 25 in which the pivot pins 13, 14 are riveted.

The bearing flanges 20, 21 are L-shaped, their shorter limbs in which the pivot pins 14 are secured projecting beyond the front edge 26 of the securing plate 15.

The upstanding longer limbs of the bearing flanges 20, 21 in which the pivot pin 13 is secured are interconnected at the back by a web 27.

Figure 5:
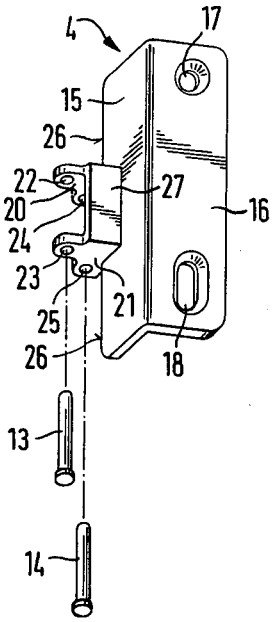
FIG. 5 is a perspective view of the stationary hinge portion of the FIG. 3 hinge.

The construction of the fixed hinge portion 4 of FIG. 3 is more clearly evident from FIG. 5.

Figure 1:
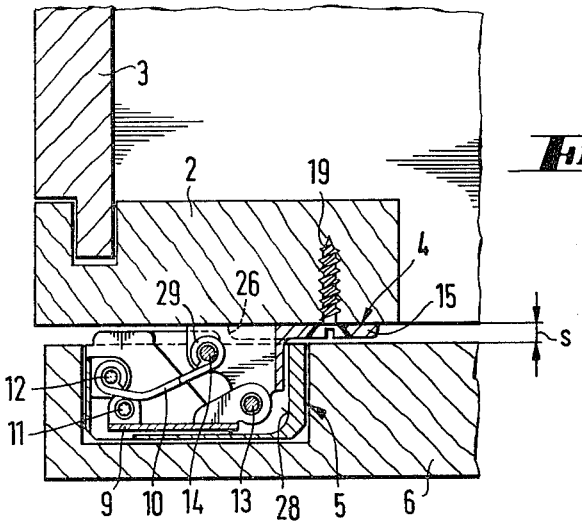
FIG. 1 is a longitudinal section through a first embodiment of a hinge in the closed condition having its stationary hinge portion secured to an end frame.

The pivot pins 13, 14 are secured in the bearing flanges 20, 21 at such a level above the front of the batten 2 but, in the FIG. 1 closed position, they project so far into the recess 28 of the cup-shaped hinge portion 5 that the outer hinge pin 14 with the surrounding rolled-in eye 29 of the link 10 is also disposed beneath the plane defined by the surfaces of the securing flanges 8. The pivot pins 11 to 14 mounting the links 9, 10 are so secured in the fixed and movable hinge portions 4, 5 and the length of the links 9, 10 and their shape is so selected that the movable hinge portion 5 can swing out of the FIG. 3 open position into the FIG. 1 closed position through about 90° in a manner such that the pivot pins 11 to 14 project into the recess 28 of the cup-shaped hinge portion 5 in the closed position.

The construction of the cup-shaped pivotable hinge portion 5 and its pivotal connection by the links 9, 10 to the bearing flanges 20, 21 of the securing plate 15 of the fixed hinge portion are identical in FIGS. 1 to 6 and therefore corresponding integers are provided with the same reference numerals. Despite a different construction for the fixed hinge portions, the hinges shown in FIGS. 1 to 3 have the same kinematic principle because of the same arrangement of the pivot pins and links in the fixed and movable hinge portions, so that each of the illustrated hinges can assume the different positions shown in FIGS. 1 to 3.

The hinge of FIG. 1 differs from that of FIG. 3 only in that the fixed hinge portion consists only of the securing plate 15 on which the L-shaped bearing flanges 20, 21 are secured. For a screw connection to the front of the batten 2, the securing plate 15 is provided with a bore 17 and an elongate hole 18.

Figure 2:
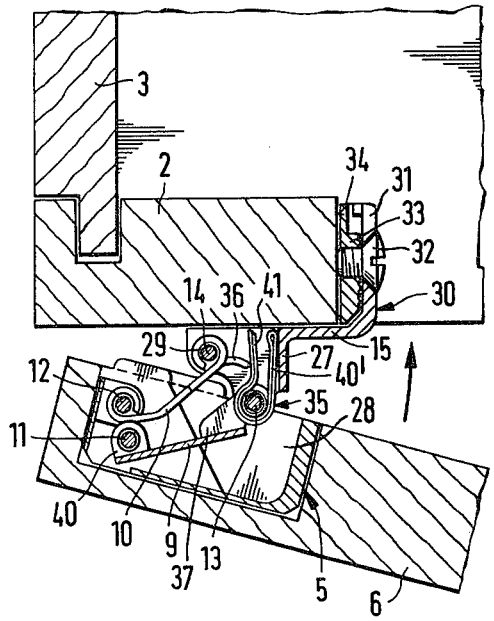
FIG. 2 is a view similar to FIG. 1 of a different embodiment of a hinge with a V-shaped spring in a slightly open condition.

In the hinge of FIG. 2, the fixed hinge portion 30 consists of an angle member of which the limb 31 flanged from the retaining plate 25 is screw-connected by a fixing screw 32 to a fitting 33 which is secured to the inner marginal side 34 of the batten 6. The limb 31 can be tightened at different levels of the fitting 33 so that the securing plate 25 can likewise be held at different levels above the surface of the batten 6 to set the gap s shown in FIG. 1 between the end frame and the door 6 when the latter is in the closed position.

The construction of the fixed hinge portion 30 with the fitting 33 will hereinafter be described in more detail with reference to FIG. 6.

The hinge of FIG. 2 is additionally provided with a two-layer V-shaped leaf-spring 35. The latter is located on the pivot pin 13 between the bearing flanges 37, 38 of the link 9 in a manner such that one of its limbs 40 is supported on the web 27 and the other limb 41 is supported on the lug 36 bent out of the rolled-in eye 29 of the link 10. The projection 36 forms a lever arm and the limb 41 of the V-shaped spring 35 exerts a torque on the link 10 through this lever arm such that, near the closed position of the hinge, the link 10 urges the hinge into its closed position and holds it there.

Figure 4:
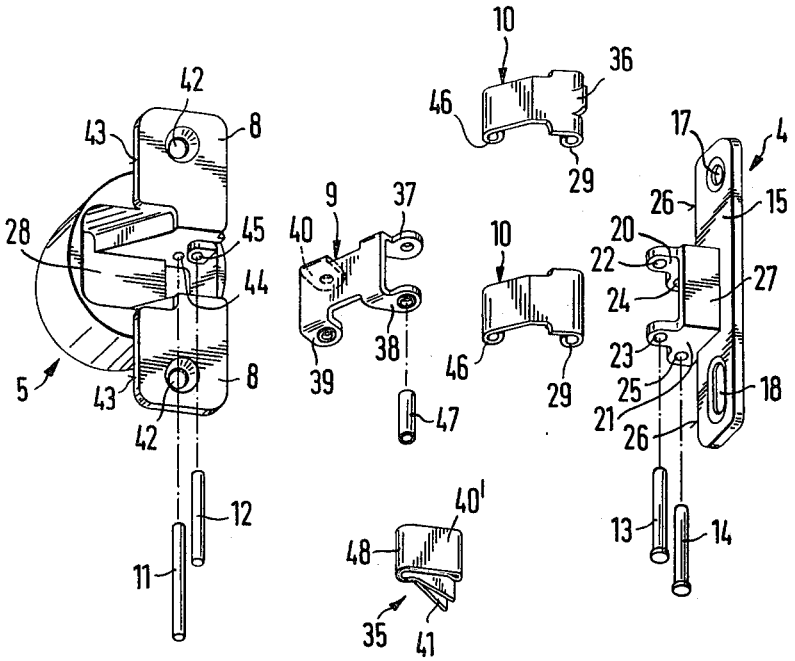
FIG. 4 is an exploded perspective view of the FIG. 1 hinge.

As best shown in FIG. 4, the hinge cup 5 is provided on its outer side with securing flanges 8 consisting of flat plate-like members separated from each other by the recess 28 of the hinge cup 5. The securing flanges 8 are provided with bores 42 for fixing screws with countersunk heads. The securing flanges 8 have rectilinear rear edges 43 extending parallel to the diametric line of the cylindrical body of the cup-shaped hinge portion 5.

At both sides of the central recess 28, the hinge portion 5 is provided with bores 44, 45 which are in registry and in which the pivot pins 11, 12 are riveted. The link 9 is pivotally mounted on the pivot pin 11 in bores disposed in bearing flanges 39, 40 of the link 9. The link 10, which is bent from a flat sheet of metal, has a rolled-in eye 46 by which it is pivotally mounted on the pivot pin 12.

The other end of the link 9 is pivotally mounted on the pivot pin 13 in the bores disposed in the bearing flanges 37, 38 of the link, the pivot pin 13 being riveted in bores 22, 23 of the bearing flanges 20, 21 of the fixed hinge portion.

In the FIG. 3 construction, the plastics sleeve 47 shown in FIG. 4 is pushed on the pivot pin 13 between the bearing flanges 37, 38, the V-shaped spring 35 with its rolled-in portion 48 connecting the limbs 40, 41 being located on the plastics sleeve.

Figure 6:
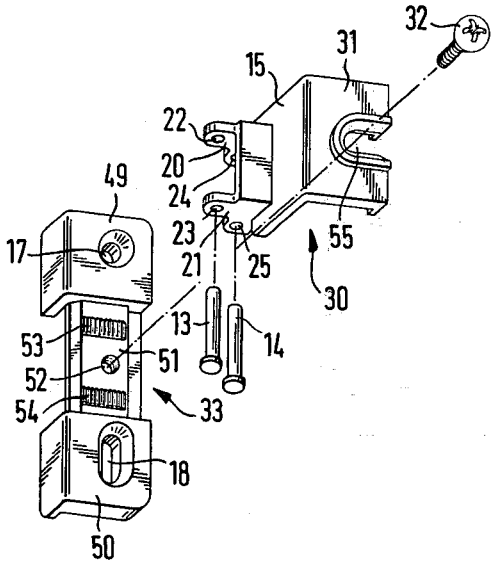
FIG. 6 is an exploded perspective view of the stationary hinge portion of the FIG. 2 hinge.

The fitting 33 shown in FIG. 6 consists of two angle members 49, 50 interconnected by a securing web 51. The securing web 51 is provided with a tapped hole 52 and fluting 53, 54. The limb 31 flanged to the retaining plate 25 can be tightened on the securing web 51 by the fixing screw 32. The limb 31 is provided with a slot 55 so that the limb 31 can be located at different levels on the retaining web 51. The spacing between the angle members 49, 50 of the fitting 33 corresponds to the width of the retaining plate 25 and the flanged limb 31 so that they are bifurcatingly framed by the angle members.

The securing plates 15 have rectilinear outer edges 26 which, in the closed position of the hinge, abut in front of the inner edges 43 of the securing flanges 8.

The fixed hinge portions are provided with an elongate hole 18 and a bore 17 for fixing screws so that they can be longitudinally adjusted.

The fixed and pivotable hinge portions may be of plastics or metal whereas the links and pivot pins are made from metal.

I claim:

1. A concealed hinge for doors, flaps or the like comprising a stationary hinge portion and a pivotable cup-shaped hinge portion which is provided with a securing flange, said hinge portions being pivotally interconnected by two links to form a four-bar linkage, characterised in that the stationary hinge portion (4, 30) consists of a flat securing plate (15) with two parallel bearing flanges (20, 21) perpendicular thereto, that the pivot pins (13, 14) for the two links (9, 10) are secured at such a height in the bearing flanges (20, 21) that, in the closed position of the hinge (1), they project into the cup-shaped hinge portion to at least under the top of the securing flange (8), and that the securing flange (8) consists of at least one flat plate-like member which, in the closed position, lies adjacent the securing plate (15) in the plane thereof.

2. A hinge according to claim 1, characterised in that the parts of the bearing flanges (20, 21) carrying the outer pivot pin (14) project beyond the outer edge (26) of the securing plate (15).

3. A hinge according to claim 1 or claim 2, characterised in that the lower edges of the bearing flanges (20, 21) are flush with the underside of the securing plate (15).

4. A hinge according to claim 3 characterized in that the securing plate (15) has a recess between the bearing flanges (20, 21).

5. A hinge according to claim 3 characterized in that the bearing flanges (20, 21) are interconnected on their inside by a perpendicular web (27).

6. A hinge according to claim 3, characterized in that the securing plate (15) comprises an outer edge (26) which is parallel to the bearing pins (13, 14) and, in the closed position of the hinge (1), abuts in front of the parallel inner edge (43) of the securing flange (8).

7. A hinge according to claim 3, characterized in that the securing plate (15) has a flanged limb (16) for securing to a perpendicular side of the fixed wall or frame member (2).

8. A hinge according to claim 3, characterized in that the securing plate (15) comprises an angle member referred to as a flanged limb (31) with said flanged limb (31) being provided with an elongated hole or slot (55) for a fixing screw (32) securable in a fitting (33) which has a retaining portion (51) parallel to the limb (31).

9. A hinge according to claim 3, characterized in that the securing plate (15) comprises an elongated hole (18) and a bore (17) for mounting purposes.

10. A hinge according to claim 3, characterized in that a spring (35) is provided which, near the closed position, biases the hinge (1) to the closed position and which is supported on the one hand by one hinge portion and on the other hand directly or indirectly by a projection (36) connected to one link (10).

11. A hinge according to claim 1 or 2, characterized in that the securing plate (15) has a recess between the bearing flanges (20, 21).

12. A hinge according to claim 11 characterized in that the bearing flanges (20, 21) are interconnected on their inside by a perpendicular web (27).

13. A hinge according to claim 11, characterized in that the securing plate (15) comprises an outer edge (26) which is parallel to the bearing pins (13, 14), and in the closed position of the hinge (1), abuts in front of the parallel inner edge (43) of the securing flange (8).

14. A hinge according to claim 11, characterized in that the securing plate (15) has a flanged limb (16) for securing to a perpendicular side of the fixed wall or frame member (2).

15. A hinge according to claim 11, characterized in that the securing plate (15) comprises an angle member referred to as a flanged limb (31) with said flanged limb (31) being provided with an elongated hole or slot (55) for fixing screw (32) securable in a fitting (33) which has a retaining portion (51) parallel to the limb (31).

16. A hinge according to claim 11, characterized in that the securing plate (15) comprises an elongated hole (18) and a bore (17) for mounting purposes.

17. A hinge according to claim 11, characterized in that a spring (35) is provided which, near the closed position, biases the hinge (1) to the closed position and which is supported on the one hand by one hinge portion and on the other hand directly or indirectly by a projection (36) connected to one link (10).

18. A hinge according to claim 1 or 2, characterized in that the bearing flanges (20, 21) are interconnected on their inside by a perpendicular web (27).

19. A hinge according to claim 18, characterized in that the securing plate (15) comprises an outer edge (26) which is parallel to the bearing pins (13, 14), and in the closed position of the hinged (1), abuts in front of the parallel inner edge (43) of the securing flange (8).

20. A hinge according to claim 18, characterized in that the securing plate (15) has a flanged limb (16) for securing to a perpendicular side of the fixed wall or frame member (2).

21. A hinge according to claim 18, characterized in that the securing plate (15) comprises an angle member referred to as a flanged limb (31) with said flanged limb (31) being provided with an elongated hole or slot (55) for fixing screw (32) securable in a fitting (33) which has a retaining portion (51) parallel to the limb (31).

22. A hinge according to claim 18, characterized in that the securing plate (15) comprises an elongated hole (18) and a bore (17) for mounting purposes.

23. A hinge according to claim 18, characterized in that a spring (35) is provided which, near the closed position, biases the hinge (1) to the closed position and which is supported on the one hand by one hinge portion and on the other hand directly or indirectly by a projection (36) connected to one link (10).

24. A hinge according to claim 1 or 2, characterized in that the securing plate (15) comprises an outer edge (26) which is parallel to the bearing pins (13, 14) and, in the closed position of the hinge (1), abuts in front of the parallel inner edge (43) of the securing flange (8).

25. A hinge according to claim 24, characterized in that the securing plate (15) has a flanged limb (16) for securing to a perpendicular side of the fixed wall or frame member (2).

26. A hinge according to claim 24, characterized in that the securing plate (15) comprises an angle member referred to as a flanged limb (31) with said flanged limb (31) being provided with an elongated hole or slot (55) for fixing screw (32) securable in a fitting (33) which has a retaining portion (51) parallel to the limb (31).

27. A hinge according to claim 24, characterized in that the securing plate (15) comprises an elongated hole (18) and a bore (17) for mounting purposes.

28. A hinge according to claim 24, characterized in that a spring (35) is provided which, near the closed position, biases the hinge (1) to the closed position and which is supported on the one hand by one hinge portion and on the other hand directly or indirectly by a projection (36) connected to one link (10).

29. A hinge according to claim 1 or 2, characterized in that the securing plate (15) has a flanged limb (16) for securing to a perpendicular side of the fixed wall or frame member (2).

30. A hinge according to claim 29, characterised in that the elongate hole (18) and bore (17) are in the flanged limb (16) of the securing plate (15).

31. A hinge according to claim 30, characterized in that a spring (35) is provided which, near the closed position, biases the hinge (1) to the closed position and which is supported on the one hand by one hinge portion and on the other hand directly or indirectly by projection (36) connected to one line (10).

32. A hinge according to claim 29, characterized in that a spring (35) is provided which, near the closed position, biases the hinge (1) to the closed position and which is supported on the one hand by one hinge portion and on the other hand directly or indirectly by a projection (36) connected to one link (10).

33. A hinge according to claim 1 or 2, characterised in that the securing plate (15) comprises an angle member of which the flanged limb (31) is provided with an elongate hole or slot (55) for a fixing screw (32) securable in a fitting (33) which has a retaining portion (51) parallel to the limb (31).

34. A hinge according to claim 33, characterised in that the fitting (33) comprises two angle members (49, 50) interconnected by a web which forms the retaining member (5) and is parallel to the flanged limb (31) of the securing plate (15).

35. A hinge according to claim 34, characterized in that the retaining member (51) is provided with a tapped hole (52) for the fixing screw (32).

36. A hinge according to claim 34 characterized in that the limb of the fitting (33) that is parallel to the securing plate (15) has a recess which corresponds to the width of the securing plate (15) and in which the securing plate (15) is framed in a biforcated manner.

37. A hinge according to claim 34, characterized in that the elongated hole (18) and bore (17) are in one of the limbs of the fitting (33).

38. A hinge according to claim 34, characterized in that a spring (35) is provided which, near the closed position, biases the hinge (1) to the closed position and which is supported on the one hand by one hinge portion and on the other hand directly or indirectly by a projection (36) connected to one link (10).

39. A hinge according to claim 33, characterised in that the retaining member (51) is provided with a tapped hole (52) for the fixing screw (32).

40. A hinge according to claim 39, characterized in that the limb of the fitting (33) that is parallel to the securing plate (15) has a recess which corresponds to the width of the securing plate (15) and in which the securing plate (15) is framed in a biforcated manner.

41. A hinge according to claim 39, characterized in that the elongated hole (18) and bore (17) are in one of the limbs of the fitting (33).

42. A hinge according to claim 39, characterized in that a spring (35) is provided which, near the closed position, biases the hinge (1) to the closed position and which is supported on the one hand by one hinge portion and on the other hand directly or indirectly by projection (36) connected to one link (10).

43. A hinge according to claim 33, characterised in that the limb of the fitting (33) that is parallel to the securing plate (15) has a recess which corresponds to the width of the securing plate (15) and in which the securing plate (15) is framed in a bifurcated manner.

44. A hinge according to claim 43, characterized in that the elongated hole (18) and bore (17) are in one of the limbs of the fitting (33).

45. A hinge according to claim 43, characterized in that a spring (35) is provided which, near the closed position, biases the hinge (1) to the closed position and which is supported on the one hand by one hinge portion and on the other hand directly or indirectly by projection (36) connected to one line (10).

46. A hinge according to claim 33, characterised in that the elongate hole (18) and bore (17) are in one of the limbs of the fitting (33).

47. A hinge according to claim 16, characterized in that a spring (35) is provided which, near the closed position, biases the hinge (1) to the closed position and which is supported on the one hand by one hinge portion and on the other hand directly or indirectly by projection (36) connected to one line (10).

48. A hinge according to claim 33, characterized in that a spring (35) is provided which, near the closed position, biases the hinge (1) to the closed position and which is supported on the one hand by one hinge portion and on the other hand directly or indirectly by a projection (36) connected to one line (10).

49. A hinge according to claim 1 or 2, characterised in that the securing plate (15) comprises an elongate hole (18) and a bore (17) for mounting purposes.

50. A hinge according to claim 49, characterized in that a spring (35) is provided which, near the closed position, biases the hinge (1) to the closed position and which is supported on the one hand by one hinge portion and on the other hand directly or indirectly by projection (36) connected to one line (10).

51. A hinge according to claim 1 or 2, characterised in that a spring (35) is provided which, near the closed position, biasses the hinge (1) to the closed position and which is supported on the one hand by one hinge portion and on the other hand directly or indirectly by a projection (36) connected to one link (10).

* * * * *